US006698847B2

(12) United States Patent
Barberis et al.

(10) Patent No.: US 6,698,847 B2
(45) Date of Patent: Mar. 2, 2004

(54) SAFETY SYSTEM FOR CONTINUOUSLY CHECKING THE INTEGRITY OF A RAILWAY TRAIN

(75) Inventors: Dario Barberis, Turin (IT); Roberto Tione, Lauriano (IT)

(73) Assignee: SAB Wabco S.p.A., Turin (IT)

( * ) Notice: Subject to any disclaimer, the term of this patent is extended or adjusted under 35 U.S.C. 154(b) by 0 days.

(21) Appl. No.: 10/305,127

(22) Filed: Nov. 27, 2002

(65) Prior Publication Data

US 2003/0127909 A1 Jul. 10, 2003

(30) Foreign Application Priority Data

Nov. 30, 2001 (IT) ..... TO2001A1124

(51) Int. Cl.[7] ..... B60T 13/00
(52) U.S. Cl. ..... 303/3; 303/7
(58) Field of Search ..... 303/3, 7, 15, 20

(56) References Cited

U.S. PATENT DOCUMENTS 6,250,723 B1 6/2001 Barberis et al.
2002/0050737 A1 * 5/2002 Root et al. ..... 303/7
2003/0047992 A1 * 3/2003 Marra et al. ..... 303/22.1

FOREIGN PATENT DOCUMENTS

DE 3838083 * 5/1990
EP 1016575 * 7/2000

* cited by examiner

*Primary Examiner*—Christopher P. Schwartz
(74) *Attorney, Agent, or Firm*—Sughrue Mion, PLLC

(57) ABSTRACT

The system comprises an electric line which extends along the train, and head apparatus and tail apparatus connected to the ends of the line. The head apparatus comprises a DC voltage supply operable to apply to the line a DC voltage of predetermined value and a detector operable to generate an alarm upon loss of a given signal on the line. The tail apparatus comprises a generator of the said signal coupled to the line and a DC/DC converter the input of which is connected to the line and the output of which is connected to the signal generator to provide to this latter a supply voltage derived from that generated by the first supply device of the head apparatus. The system is such that an interruption of the train capable of causing interruption to the said line is able to cause deactivation of the signal generator of the tail apparatus, which can be detected and signaled by the detector of the head apparatus.

13 Claims, 2 Drawing Sheets

SAFETY SYSTEM FOR CONTINUOUSLY CHECKING THE INTEGRITY OF A RAILWAY TRAIN

BACKGROUND OF THE INVENTION

The present invention relates to a safety system for continuously checking the integrity of a railway train which comprises a head locomotive followed by a plurality of entrained vehicles, and which is provided with a pneumatic braking system including a general duct which extends along the entire train.

SUMMARY OF THE INVENTION

The object of the invention is to provide an improved system which allows continuous testing of the integrity of a railway train, in particular a very long railway train. A further object of the invention is to provide a system which further allows the emergency safety braking of two or more parts into which the train may possibly become separated.

This and other objects are achieved according to the invention with a system having the characteristics defined in the following claims.

According to a first aspect of the invention, the system comprises:

an electrical supply line which extends along the entire train from the locomotive at the head to the vehicle at the tail; and head apparatus and tail apparatus installed on the head locomotive and the tail vehicle respectively, and connected to the ends of the said electrical supply line; and in which the head apparatus comprises a first DC voltage supply operable to apply to the said line a first DC voltage having a predetermined value;

a detector connected to the said line and operable to detect the presence on the line of a signal having predetermined characteristics, and to generate an alarm upon loss of the said signal on the line;

the tail apparatus comprising:

a signal generator having the said predetermined characteristics, coupled to the electrical supply line, and a DC/DC converter the input of which is connected to the said line and the output of which is connected to the said signal generator to provide to this latter a supply voltage derived from that generated by the first supply source of the head apparatus;

the system being such that an interruption of the train capable of causing an interruption of the said line is able to cause a deactivation of the signal generator of the tail apparatus which can be detected and signalled by the detector of the head apparatus.

Further characteristics and advantages of the invention will become apparent from the following detailed description given purely by way of non-limitative example with reference to the attached drawings, in which:

DETAILED DESCRIPTION OF THE INVENTION

Figure 1:
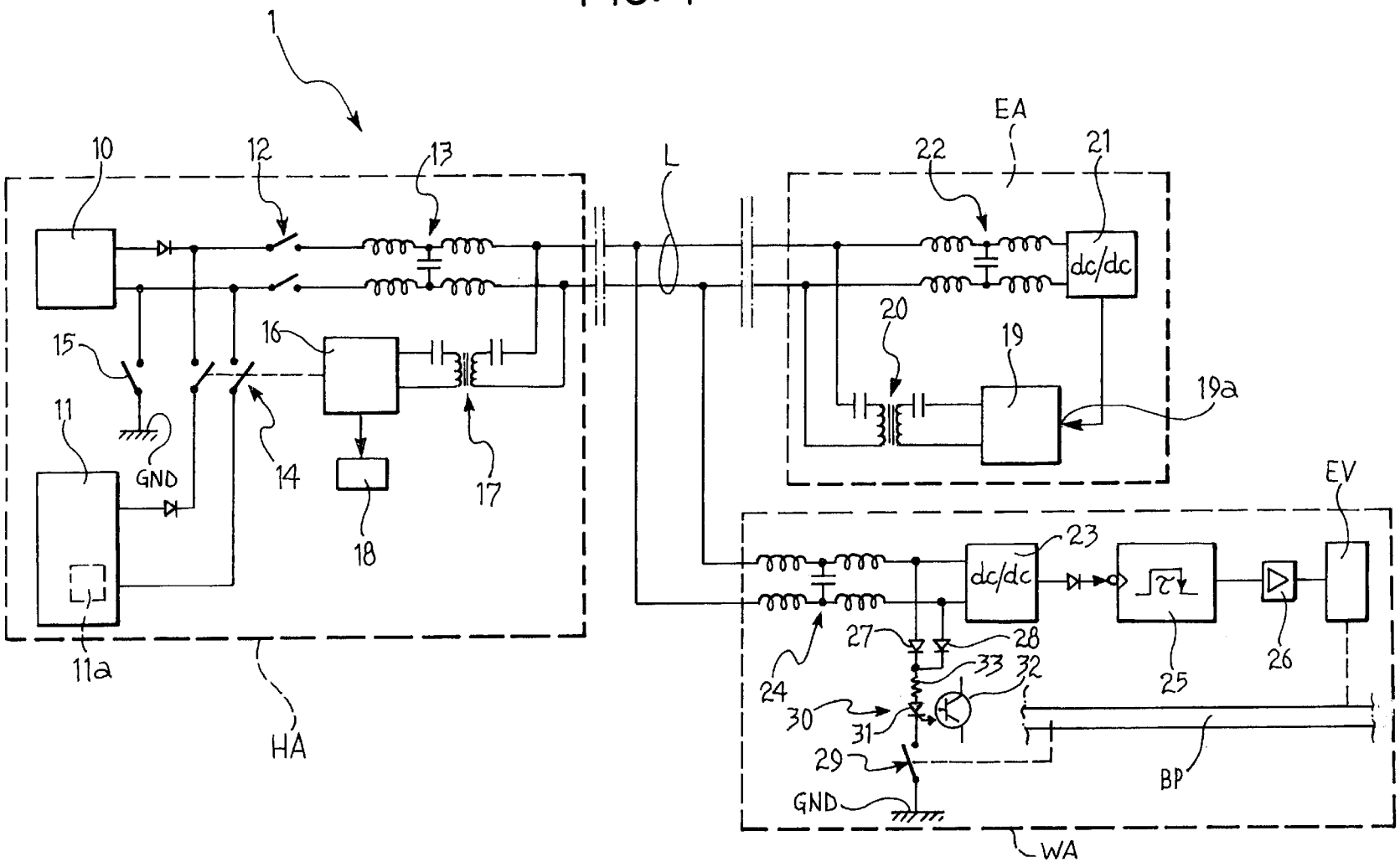
FIG. 1 is a schematic diagram partially in block diagram form, of one embodiment of a system according to the invention.

With reference to FIG. 1, the reference numeral 1 generally indicates a safety system according to the invention for continuously testing the integrity of a railway train.

The system 1 essentially comprises an electrical supply line L which extends along the entire train from the locomotive at the head to the vehicle at the tail. In the embodiment illustrated the line L is a twin filament line. This line L can be utilised for the electrical supply of the apparatus and various devices of the train.

The system 1 further comprises head apparatus HA installed on the locomotive at the head (not illustrated) of the train, as well as tail apparatus EA associated with the end vehicle or tail (not illustrated) of the train.

The head apparatus HA and tail apparatus EA are connected to the ends of the electrical supply line L.

The system 1 further comprises a plurality of wagon apparatus WA of which only one is illustrated in the drawing. Such wagon apparatus WA is installed on each wagon drawn by the head locomotive including the tail wagon or vehicle.

The head apparatus HA comprises a first DC voltage supply 10 operable to apply to the line L a DC current having for example a value of 48 V. This first supply is of relatively low power and is floating with respect to ground or earth and is moreover insensitive to unbalancing of the line L with respect to ground or earth.

The head apparatus further includes a second voltage supply 11 of relatively high power, operable to apply to the line L a DC current of for example 230 V. This supply is of balanced type and is sensitive to possible unbalancing of the line L with respect to ground or earth. The output of the voltage supply 11 is coupled to the input of the line L through a switching device 12 and an AC/DC separator device generally indicated 13 and comprising, for example, and in a manner known per se, a plurality of inductors and at least one capacitor.

The output of the voltage supply 11 is coupled to the output of the voltage supply 10 by a controlled isolator switch 14 connected upstream of the emergency switch 12.

The reference numeral 15 in the drawing indicates a switch interposed between ground GND and one of the conductors of the line L. The functions of such switch will be explained hereinafter.

The tail apparatus EA comprises a signal generator 19, operable to generate an AC signal having a predetermined characteristic, such as a frequency, for example equal to 10 KHz, or a modulation or numerical code. This generator 19 has its output coupled to the line L through a coupling device 20 operable to pass AC signals and to block DC signals. This device, known per se, comprises a transformer and a pair of capacitors in the indicative example illustrated.

The tail apparatus EA further includes a DC/DC converter 21 the input of which is connected to the line L through an AC/DC separator 22 similar to the separator 13 previously described. The output of the converter 21 is connected to a supply input 19*a* of the signal generator 19.

Now, referring again to the head apparatus HA, this further includes a detector 16 the input of which is connected to the line L downstream from the separator 13 by means of a coupling device 17 similar to the device 20 previously described.

The detector 16 is intended to detect the presence on the line L of the signal produced by the generator 19. Upon loss of the said signal on the line L the detector 16 activates an alarm device 18 and causes opening of the (normally closed) switch 14 thus causing uncoupling of the supply 11 from the line L.

Each wagon apparatus WA includes a DC/DC converter 23 the input of which is coupled to the line L via an AC/DC separator 24 similar to the separators 13 and 22 just described.

The output of the converter 23 is connected to a monostable circuit 25 of the type which can be activated by a falling edge. The output of this monostable circuit is coupled, via an amplifier 26 and a solenoid valve EV of the wagon which, in a manner known per se, is connected to the general duct BP of the pneumatic braking installation of the train. This duct extends along the entire train. The solenoid valve EV is for example of the type described in U.S. Pat. No. 6250723.

The excitation of the solenoid valve EV causes a controlled discharge of the pressure in the local section of the general duct or brake pipe BP.

The reference numerals 27 and 28 indicated two diodes having their respective anodes connected to two input terminals of the converter 23 and the respective cathodes of which are interconnected together to form overall a kind of OR circuit. Between the cathodes of these diodes 27,28 and ground GND is disposed a pressure sensor 29 of the threshold switch type, associated with the local section of the general braking duct BP. A current limiting resistor 33 is connected in series with the switch 29.

The switch 29 is normally open when the pressure in the general duct BP exceeds a predetermined threshold value, and closes when this pressure falls below a value close to or equal to this threshold value.

Between the cathodes of the diodes 27, 28 and the switch 29 is interposed a photo coupler generally indicated 30, comprising an emitter diode 31 coupled to a phototransistor 32. This photo coupler 30 makes it possible to generate a signal indicative of the state of the pressure threshold switch 29 and therefore the pressure level in the general duct BP.

The diodes 27, 28 make the polarity of the coupling of the input of the converter 23 to the line L of no significance.

The system described above functions essentially in the following manner.

Switches 12 and 14 of the head apparatus HA are normally closed, whilst the switch 15 thereof is normally open.

The voltage supply source 10 applies to the line L a DC voltage with sufficient power that the converter 21 can apply the intended supply voltage to the generator 19. This generator emits on the line L the appropriate signal, for example an AC signal at the predetermined frequency of 10 KHz.

At the other end of the line L, in the head apparatus, the signal produced by the generator 19 of the tail apparatus is detected by the detector device 16, which continues to maintain the switch 14 closed so that the supply device 11 remains coupled to the line L.

In normal conditions, in particular in conditions of complete integrity of the railway train, the respective DC/DC converter 23 of each wagon apparatus WA, by means of the line L, receives at its input a DC voltage coming from the supply device 11 of the head apparatus. The output of this converter 23 applies to the associated monostable circuit 25 a DC voltage so that this monostable device remains deactivated.

In normal conditions the pressure in the general duct BP exceeds the minimum threshold value associated with the sensor 29 so that the switch 29 of each wagon apparatus WA is open.

The safety system 1 is able to react to a number of emergency situations in the modes which will now be described.

If emergency switch 12 in the head locomotive is opened, both the voltage supply devices 10 and 11 are decoupled from the line L. Consequently the converters 23 of all the wagon apparatus WA, upon loss of the voltage on the line L applied by the voltage supply device 11, cease to provide an output DC voltage to the associated monostable 25. The falling edge of the output voltage of the converter 23 causes activation of the monostable circuit 25, which for a predetermined time causes excitation of the associated solenoid valve EV causing a controlled discharged of the pressure in the local section of the general duct BP. The almost simultaneous discharge of pressure in the local sections of the general duct involves, in a manner known per se, activation of the brakes of the entire train, which is therefore braked in an extremely rapid and uniform manner, even before possible intervention of the so called automatic continuous brake UIC the intervention of which, typically sequential, can be dangerous in the case of very long trains.

A further emergency situation is represented by an interruption of the line L, due for example to an interruption in the integrity of the railway train itself. In this case the detector 16 of the head apparatus HA no longer detects the signal produced by the generator 19 of the tail apparatus EA, and therefore causes opening of the switch 14 and decoupling of the voltage supply device 11 from the section of the line L which is still connected to the head apparatus HA. Consequently, both in the wagons upstream and in the wagons downstream of the interruption in the line L, the input voltage to the respective DC/DC converters 23 falls and this involves excitation of the associated solenoid valves EV and controlled discharge of pressure in the local section of the general duct. In this case also, therefore, an effective, rapid, uniform, braking takes place simultaneously in the two, or possibly more, parts of the train.

As well as the situations described above, an emergency situation can also occur in which the general braking duct BP is interrupted along with the train, without this involving an interruption in the line L. In this case, the pressure switch 29 associated with the wagon or wagons closest to the point of interruption or rupture of the duct close causing an unbalancing of the line L with respect to ground or earth. This unbalancing is conveniently detected by a suitable circuit 11*a*, known per se, associated with the voltage supply device 11. This unbalancing detector 11*a* causes the deactivation of the voltage supply device 11 and this in turn causes excitation of the various solenoid valves EV and the controlled discharge of the pressure in the general duct BP with an almost simultaneous braking operation in all the wagons, also in this case more rapidly than the possible intervention of the automatic continuous brake UIC.

The switch 15 of the head apparatus HA on the other hand makes it possible to effect a test or diagnosis of the efficacy of the pressure threshold switches 29 of the wagon apparatus WA. Such diagnosis is conveniently effected when the general braking duct BP is charged, or rather operating at normal functioning pressure.

Upon commencement of the charging of the duct BP the pressure threshold switch 29 of each wagon apparatus is closed. If now the switch 15 is closed the supply device 10 is connected to ground or earth and a current now flows through the photo diode 31 of the associated photo couplers 30 the photo transistors of which make it possible to verify and signal the effective closure condition of the pressure threshold switches 29.

During charging of the duct BP, as soon as the pressure of this duct exceeds a predetermined value, the switches 29 open and this condition can be again detected by means of the associated photo couplers 30. Once the diagnosis is completed the switch 15 of the head apparatus HA can be opened again.

In a manner not illustrated, at the output of the converter 23 of each wagon apparatus WA there can be connected control devices (such as relays or solenoid valves) for safety functions such as, for example, inhibition of traction of possible intermediate locomotives in the train or inhibition of local re-supply of pressure to the general duct BP by intermediate locomotives.

Figure 2:
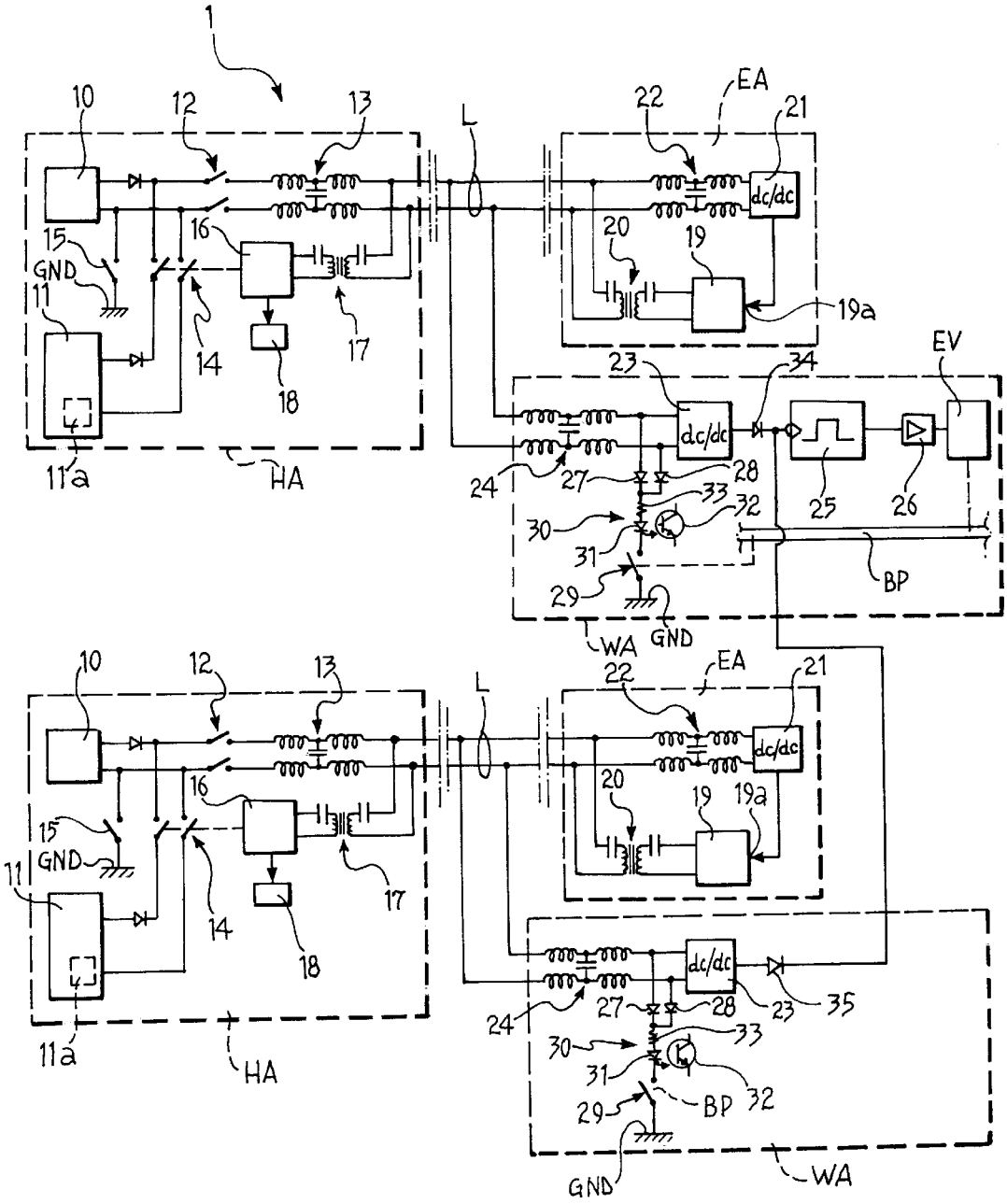
FIG. 2 is a diagram of an alternative embodiment.

FIG. 2 shows a system essentially duplicated for safety redundancy purposes. It is noted in particular that this system includes duplicated identical head apparatus HA and duplicated identical tail apparatus EA coupled by two lines L. Each wagon is equipped with duplicated wagon apparatus WA and WA' each appertaining to one of the two lines L. The apparatus WA' does not include its own monostable circuit 25 and its own solenoid valve EV but rather the output from the converter is coupled to the input of the monostable circuit of the other wagon apparatus WA. Coupling of the outputs of the converters 23 of the apparatus WA and the apparatus WA' to the monostable circuit 25 shared between them is achieved by means of two diodes 34 and 35 the cathodes of which are connected together. The overall duplicated arrangement makes it possible to avoid undue braking in the case of breakdown of one of the two systems belonging to the common monostable circuit.

Naturally, the principle of the invention remaining the same, the embodiments and details of construction can be widely varied with respect to what has been described and illustrated purely by way of non-limitative example, without by this departing from the ambit of the invention as defined in the attached claims.

What is claimed is:

1. A safety system for continuously testing the integrity of a railway train comprising a head locomotive followed by a plurality of entrained vehicles or wagons and provided with a pneumatic braking system including a general duct which extends along the entire train; the system comprising an electrical supply line which extends along the entire train from the head locomotive to the tail vehicle; and head apparatus and tail apparatus installed on the head locomotive and the tail vehicle respectively and connected to the ends of the said electrical supply line, and in which the head apparatus comprises a first DC voltage supply device operable to apply to the said line a first DC voltage of predetermined value;

a detector connected to the said line and operable to detect the presence on the line of a signal having a predetermined characteristic, and to generate an alarm upon loss of the said signal on the line;

the tail apparatus comprising a signal generator having said predetermined characteristic, coupled to the said electrical supply line, and a DC/DC converter the input of which is connected to the said line and the output of which is connected to the said signal generator to provide to said signal generator a supply voltage derived from that generated by the supply device of the head apparatus;

the system being such that an interruption of the train capable of causing an interruption to the said line is able to cause deactivation of the signal generator of the tail apparatus which can be detected and signalled by the detector of the head apparatus.

2. A system according to claim 1, in which the head apparatus further includes a second DC voltage supply device operable to apply to the said line a second DC voltage of predetermined value;

the system further comprising a further apparatus, or wagon apparatus installed on each entrained wagon or vehicle and connected locally to the said electrical supply line;

each said wagon apparatus comprising detector means operable to detect the presence on the said line of the voltage delivered by the second supply device of the head apparatus, and which in the absence of detection of this voltage are operable to cause activation of a solenoid valve device capable of causing controlled discharge of the pressure in the local section of the said general duct;

the system being such that an interruption of the train capable of causing an interruption of the said line is able to cause deactivation of the signal generator of the tail apparatus, and consequent decoupling of the second supply device by the detector of the head apparatus, and activation of the solenoid valve devices for local discharge of the general duct.

3. A system according to claim 2, in which the said detector means of each wagon apparatus comprise a DC/DC converter the input of which is connected to the said supply line and the output of which is connected to a monostable circuit which is activatable by a falling edge and is coupled to a solenoid valve for local discharge of the general duct.

4. A system according to claim 1, in which a normally closed switch is interposed between the said first and second supply device of the head apparatus and the said line the normally closed switch being operable in emergency conditions, in such a way as to cause artificial interruption of the said electrical supply line.

5. A system according to claim 2, in which each said wagon apparatus comprises first sensor means connected to the said electric supply line and operable, when the local pressure in the general duct falls below a predetermined value, to cause an unbalancing of the said line with respect to ground or earth, and in which the head apparatus comprises second sensor means operable to detect an unbalanced condition of the said line with respect to ground or earth and to cause in this case deactivation of the said second voltage supply device.

6. A system according to claim 2, in which the output of the second voltage supply device of the head apparatus is connected to the said line via a switch device controlled by the said signal presence detector.

7. A system according to claim 2, in which the output of the head apparatus and the inputs of the tail apparatus and each wagon apparatus are coupled to the said line via respective AC/DC separators.

8. A system according to claim 1, in which the input of the said detector of the head apparatus and the output of the AC signal generator of the tail apparatus are connected to the said electrical supply line by means of respective coupling devices operable to pass AC signals and to block DC voltages.

9. A system according to claim 5, in which the said first sensor means include a pressure threshold switch connected on one side to ground and on the other to the conductors of the said electrical supply line via a current limiter element and a half bridge of diodes connected in OR mode.

10. A system according to claim 9, in which a signalling and/or diagnosis device is connected in series with the said pressure threshold switch and disposed in such a way that it is activated when the local pressure in the general duct is less than a threshold associated with this switch.

11. A system according to claim 10, in which the head apparatus includes a diagnosis switch operable to connect a conductor of the said electrical line to the ground or earth in such a way that actuation of this diagnosis switch during charging of the general duct allows testing of the functionality of the pressure threshold switches of the wagon apparatus.

12. A system according to claim 3, in which to the output of the DC/DC converter of at least one wagon apparatus are connected devices for controlling the safety functions.

13. A system according to claim 3, comprising at least duplicated head apparatus and duplicated tail apparatus coupled by respective electric supply lines, and duplicated wagon apparatus in each wagon, the DC/DC converters of which are coupled to the same monostable circuit coupled to a solenoid valve for discharge of the general duct.

* * * * *